US010960238B1

(12) United States Patent
Reele et al.

(10) Patent No.: US 10,960,238 B1
(45) Date of Patent: Mar. 30, 2021

(54) FACE MASK

(71) Applicants: Samuel Reele, Rochester, NY (US); Louis Christopher Goeckel, Baldwinsville, NY (US)

(72) Inventors: Samuel Reele, Rochester, NY (US); Louis Christopher Goeckel, Baldwinsville, NY (US)

( * ) Notice: Subject to any disclaimer, the term of this patent is extended or adjusted under 35 U.S.C. 154(b) by 0 days.

(21) Appl. No.: 17/083,413

(22) Filed: Oct. 29, 2020

Related U.S. Application Data

(60) Provisional application No. 63/103,203, filed on Jul. 23, 2020.

(51) Int. Cl.
*A62B 18/02* (2006.01)
*A41D 13/11* (2006.01)
(Continued)

(52) U.S. Cl.
CPC ..... *A62B 18/025* (2013.01); *A41D 13/1107* (2013.01); *A41D 13/1161* (2013.01); *A41D 13/1184* (2013.01); *A62B 18/02* (2013.01); *A62B 18/082* (2013.01); *A62B 18/084* (2013.01); *A62B 23/02* (2013.01); *A41D 2500/30* (2013.01)

(58) Field of Classification Search
CPC .. A62B 7/00; A62B 7/10; A62B 18/00; A62B 18/02; A62B 18/025; A62B 18/08; A62B 18/082; A62B 18/084; A62B 23/00; A62B 23/02; A62B 23/025; A62B 23/06; A41D 13/11; A41D 13/1107; A41D 13/1138; A41D 13/1146; A41D 13/1115; A41D 13/1123; A41D 13/113; A41D 13/1153; A41D 13/1161; A41D 13/1169; A41D 13/1176; A41D 13/1184
See application file for complete search history.

(56) References Cited

U.S. PATENT DOCUMENTS 2,067,026 A * 1/1937 Schwartz ..... A41D 13/11 128/206.12
3,521,630 A 7/1970 Westberg et al.
(Continued)

OTHER PUBLICATIONS

World's First Transparent FDA Registered, N99+ Smart Mask With UV-C Sterilizing That Shows Off Your Smile, https://www.yankodesign.com/2020/06/24/worlds-first-fda-registered-clear-uv-c-sterilizing-smart- mask-transparent-n99-mask/, Jun. 24, 2020.
(Continued)

*Primary Examiner* — Colin W Stuart
(74) *Attorney, Agent, or Firm* — Tracy Jong Law Firm; Tracy P. Jong; Cheng Ning Jong

(57) ABSTRACT

A face mask for a user having a face, a nose and a mouth, the face mask including a covering including a periphery, a top end, a bottom end, the covering configured to cover at least a portion of the nose of the user and at least a portion of the mouth of the user, wherein the covering is configured substantially according to the shape and size of the nose of the user and the mouth of the user; a first opening disposed at a first location of the covering; a second opening disposed at a second location of the covering; a first filter configured for covering the first opening; a second filter configured for covering the second opening; and a seal disposed on the periphery.

20 Claims, 12 Drawing Sheets

(51) Int. Cl.
*A62B 18/08* (2006.01)
*A62B 23/02* (2006.01)

(56) References Cited

U.S. PATENT DOCUMENTS 4,951,664 A * 8/1990 Niemeyer ..... A62B 18/025 128/205.27
5,080,094 A * 1/1992 Tayebi ..... A62B 23/025 128/205.29
6,123,077 A 9/2000 Bostock et al.
6,196,223 B1 3/2001 Belfer et al.
6,718,981 B2 * 4/2004 Cardarelli ..... A61F 9/045 128/205.27
7,762,257 B2 * 7/2010 Chiam ..... A41D 13/1161 128/206.21
8,622,059 B2 1/2014 Kleman
8,874,251 B2 * 10/2014 Thornton ..... B29C 64/386 700/118
10,660,385 B2 5/2020 Nagao et al.
2008/0092909 A1 4/2008 Hahne
2008/0223370 A1 * 9/2008 Kim ..... A62B 23/02 128/206.17
2010/0126504 A1 * 5/2010 Johnstone ..... A61F 9/029 128/202.13
2010/0258130 A1 * 10/2010 Wu ..... A41D 13/1107 128/206.13
2011/0061656 A1 * 3/2011 Matich ..... A62B 23/025 128/206.25
2011/0247626 A1 * 10/2011 Chuang ..... A62B 23/02 128/206.19
2017/0276958 A1 * 9/2017 Friedfeld ..... G02C 5/008
2017/0318875 A1 * 11/2017 Henderson ..... A41D 13/1115
2019/0262567 A1 * 8/2019 Davis ..... A61M 16/0644

OTHER PUBLICATIONS

SEEUS95 is the world's first self-adhering N95 transparent shield and respirator, https://www.designboom.com/design/seeus95-mask-self-adhering-transparent-n95-08-31-2020/, Aug. 31, 2020.
https://readimask.com/.

* cited by examiner

FACE MASK

PRIORITY CLAIM AND RELATED APPLICATIONS

This non-provisional application claims the benefit of priority from provisional application U.S. Ser. No. 63/103,203 filed on Jul. 23, 2020. Said application is incorporated by reference in its entirety.

BACKGROUND OF THE INVENTION

1. The Field of the Invention

The present invention relates to a face mask. More specifically, the present invention is directed to a health mask suitable for protecting its wearer or user and those around the wearer from a highly communicable airborne disease.

2. Background Art

The COVID-19 coronavirus pandemic initiated in China in 2019 before migrating to Italy and Spain. It then migrated to New York from Italy in early months of 2020 and the west coast of the United State (US) from China. It quickly spread throughout the world and the US in the ensuing months. The virus is 10 nm in size and lives for unusually long periods of time on paper, e.g., 3 days, as well as stainless steel, e.g., 24 hours. Current health mask designs allow for the health filter to move towards the mouth when breathing in and away from the mouth when breathing out. This causes the filter to flex excessively and vibrate at a low frequency of about 70 Hz. Blowout breaches to the side and back of the mask can occur when a user is breathing out, significantly impacting protection to others. When breathing in, the motion makes breathing more difficult. Water vapor can build up in the face mask, quickly affecting the transmissivity of oxygen, causing difficulty in breathing and loss of filtering. A water vapor molecule measures 275 picometers across whereas an oxygen molecule is 300 picometers across. The virus is believed to be transmitted from person-to-person through water droplets during conversation and especially during a cough or sneeze up to 20 ft. Minimal recommendations of socially distancing from person-to-person of 6.0 feet have been established by the Center for Disease Control (CDC) in the US. The worst conditions for spread appear to be indoors in closed air circulating environments such as indoor restaurants, malls, bars, casinos, churches, schools, nursing homes, etc. Persons may transmit the virus when not exhibiting symptoms and as such asymptomatic transmission has been difficult to identify. The disease is most terminal to elderly people, and people with underlying conditions such as heart disease, kidney disease, or obesity. In addition, it has been found to be fatal in young people and passed on to unborn children. The virus has also been shown to mutate, quickly raising concerns about second wave of exposures. In fact, the Italy to New York transmission was a mutation from the China strain. The issue is close contact and circulating contaminated air. As such, the first level of defense, and the only level of defense to date with no current vaccine and/or future mutations, has been wearing a mask, followed by disinfecting surfaces and controlling air flows. Current mask designs and mask materials offer limited protection, allow spreading to occur and have multiple adverse side effects. For instance, the added plastic shields on one's face can cause skin skiving and scarring over time, as well as eyeglasses fogging up. To date, although a number of mask designs have evolved, they are however still not adequately addressing most shortcomings, especially air flow dynamics within the mask, virus breach of the mask and the lack of eye protection.

The virus transmits and lives on moisture/moist surfaces. Current mask designs inadequately protect one's nose and mouth and most offer no protection for eyes, the organ in the body having the 2nd highest percentage of water. Those that do offer some protection impact the eyesight of their users and fog up. Various design attempts to hold a mask tightly to the mouth and to prevent the mask from slipping off the nose during speech/wearing time, require a second plastic shield to be used by health care professionals. Metal nose clips, doubles ties around each ear, double elastic bands (one over each ear) plus one over head (total of three) are attempted to address these. Slippages due to manual tying of cloth bands, the inability to keep tight, the need for another person to do the tying all contribute to the lack of acceptance of prior art face masks or face shields. Further, cross contamination occurs from mask to hands during mask removal. Plastic shields can rub into soft facial skin and can cause open wounds and scarring when health officials use them for multiple hours at a time.

Some prior art masks have moveable filter membranes. Due to the size of the virus, the filter material is dense and it is not readily permeable to air flow. As such, when breathing out, the filter membrane flexes out, creates blowout leakage around the sides of the mask, and up under glasses causing fogging. These masks facilitate sideways and backwards expulsion of one's breath, carrying virus contaminated air from an infected person. When breathing in, the filter membrane gets sucked in toward the mouth and nose causing difficulty in breathing through water vapor saturated areas of the filter. Thus, the filter membrane flexes back and forth like a sound speaker at low frequency, affecting the effectiveness of the filter. Difficulty in breathing causes one to breath harder, further exasperating the problems above.

Some prior art masks are single-use masks that result in a tremendous amount of wastes. Further, there are expensive filter materials are very large and not strategically used. Yet further, most face masks are for single uses and none are re-useable or recyclable. Those that are reusable are made of silicone which is not sustainable or even recyclable.

Prior art masks create a safety issue as the majority of a person's face is covered. As the face of a user is at least partially covered with a mask, a suspect or criminal may not be easily identified based upon facial recognition upon committing a crime. Prior art masks are made solely for a single application, e.g., to reduce the transmission of COVID-19, these masks are not easily converted to for use as allergy or second-hand smoke filter masks.

Current attempts at shielding eyes require a secondary large wrap around plastic shielding, thus doubling the difficulty in attachment to the head, requiring two people to attach, creates excessive glare, and eye strain, and do not protect from a rear entry of air flow carrying viruses, e.g., due to a sneeze from behind or air turbulence from contaminated air circulation fan, air conditioning or wind.

Other attempts, e.g., by Ellebabe, have a plastic extension sewn into the cloth mask and use stretchable cloth to hold the plastic piece to the face. This concept is not useable for existing eye glass wearers. In addition, it creates fogging, as well as self-circulation virus exposure to a COVID-19 positive person: mouth and nose to eyes.

Various attempts have been made to provide protection to the face of a user. However, none of the face masks and protective devices provide adequate protection, comfort and effectiveness against the highly communicable COVID-19. U.S. Pat. No. 6,196,223 discloses a single-piece facial mask with strapless connection to ears. U.S. Patent No. 20080092909 discloses a central semi-transparent area via flexible and spreadable cloth. U.S. patent Ser. No. 10/660,385 discloses a stretchable cord for attachment to both ears. U.S. Pat. No. 3,521,630 discloses a N95 filter integral to a fabric mask attached around ears by ties and/or stretchable cords. U.S. Pat. No. 6,123,077 discloses a smart fold and U.S. Pat. No. 8,622,059 discloses a fog-free mask. Australian Pat. Pub. No. 2011346721 discloses a mask with wrap-around visor. Ellebabe discloses a plastic extension for eye coverage sewn into cloth masks. Avery discloses a clear silicone mask with glue to adhere to the face. There are concerns over the durability of the glue used due to sweating, sunscreen and stresses exerted during the use of the mask, e.g., talking of the user, etc. Any extension of the silicone materials over eyes is not practical due to optical impact of the silicone to the user. Furthermore, breathability is impacted as evidenced by the extension under chin that traps carbon dioxide.

MIT/Lincoln Labs, as advertised by Design Boom in https://www.designboom.com/design/seeus95-mask-self-adhering-transparent-n95-08-31-2020/, discloses a silicone partial face mask with two removeable filter strips on the side of the cheek area. The location of the filters hinders expulsion of carbon dioxide and the intake of oxygen has to travel through residual carbon dioxide. Silicone outgases over long periods of time. Contrast this with Polyethylene terephthalate (PET) which is not porous and cleanable by commercially available cleaners. It has been suggested that cleaning of reusable masks may be performed using a dishwasher. However, there are concerns that the user of a dishwasher can cause cross contamination of the virus into the dishwasher and subsequently onto dishes used in subsequent use of the dishes. An extension of silicone over eyes is not practical due to the impact on the lack of visibility when silicone is used. Yanko discloses a mask having a similar design albeit with filters of different geometries and modifications over the bearded area.

There exists a need for a face mask effective for filtering out COVID-19 and other airborne communicable diseases while being comfortable to wear and not posing as a security risk due to a face mask being capable of obscuring one's facial features for facial recognition, both manually or automatically using facial recognition algorithms.

SUMMARY OF THE INVENTION

In accordance with the present invention, there is provided a face mask for a user having a face, a nose and a mouth, the face mask including:

(a) a covering including a periphery, a top end, a bottom end, the covering configured to cover at least a portion of the nose of the user and at least a portion of the mouth of the user, wherein the covering is configured substantially according to the shape and size of the nose of the user and the mouth of the user;

(b) a first opening disposed at a first location of the covering;

(c) a second opening disposed at a second location of the covering;

(d) a first filter configured for covering the first opening;

(e) a second filter configured for covering the second opening; and (f) a seal disposed on the periphery, wherein when the covering is disposed over the nose and the mouth of the user, the seal is seated on the face of the user, forming an inner space and an outer space, the inner space is defined by a space between the covering and the user, limiting communication of a medium between the inner space and the outer space through the seal, forcing communication between the inner space and the outer space through the first filter and the second filter.

In one embodiment, the user further having eyes, the covering is configured to cover at least a portion of the eyes of the user with an extended portion extending from the top end of the covering, wherein the extended portion is configured substantially according to the shape and size of the eyes of the user.

In one embodiment, the face mask further includes a vision-altering layer disposed on the extended portion. In one embodiment, the extended portion further includes at least one vent. In one embodiment, the face mask further includes a fastener disposed on the extended portion, wherein the fastener configured for fastening the face mask to a pair of eye glasses. In one embodiment, the face mask further includes a fastener disposed on the extended portion, wherein the fastener configured for fastening the face mask to at least one temple of a pair of eye glasses. In one embodiment, the vision-altering layer includes a vision-altering layer selected from the group consisting of a vision corrective lens, a light-sensitive darkening device, an anti-reflective coating, a polarized lens and a night vision device. In one embodiment, at least one of the first filter and the second filter is configured to be replaceable. In one embodiment, at least one of the first filter and the second filter includes a nonwoven filter. The covering can be constructed from Polyethylene terephthalate (PET), Lexan® or a semi-rigid thin plastic, a clear material, a tinted material, a material capable of filtering out damaging UV rays, or any combinations thereof. In one embodiment, the face mask further includes an extension tab extending from the bottom end of the covering, wherein the extension tab is configured to provide a grasping point for removing or reseating the face mask. In one embodiment, the first opening is disposed in a first plane and the second opening is disposed in a second plane, the first plane is disposed at an angle of at least about 45 degrees with respect to the second plane. In one embodiment, the covering further includes an inner surface, wherein at least one of the first filter and the second filter is disposed on the inner surface. In one embodiment, the covering further includes an outer surface, wherein at least one of the first filter and the second filter is disposed on the outer surface. In one embodiment, the face mask further includes a pair of temples configured to be attachable to the extended portion. In one embodiment, an opening further includes a protrusion disposed on its periphery, the protrusion extending in a direction normal to the opening, the protrusion is configured to receive a filter before receiving a cap pressed against the protrusion to secure the filter to the opening. In one embodiment, the face mask further includes a third filter configured for covering the first opening and a fourth filter configured for covering the second opening, wherein the covering further includes an inner surface and an outer surface and one of the first filter and the third filter is configured to cover the first opening at one of the inner surface and the outer surface, the other one of the first filter and the third filter is configured to cover the first opening at the other one of the inner surface and the outer surface and one of the second filter and the fourth filter is configured to cover the second opening at one of the inner surface and the outer surface, the other one of the third filter and the fourth filter is configured to cover the second opening at the other one of the inner surface and the outer surface.

An object of the present invention is to provide a face mask effective in carrying out its intended purposes, i.e., to eliminate or reduce the transmission of highly communicable airborne diseases.

Another object of the present invention is to provide a cost effective and comfortable face mask effective in carrying out its intended purposes, i.e., to eliminate or reduce the transmission of highly communicable airborne diseases.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
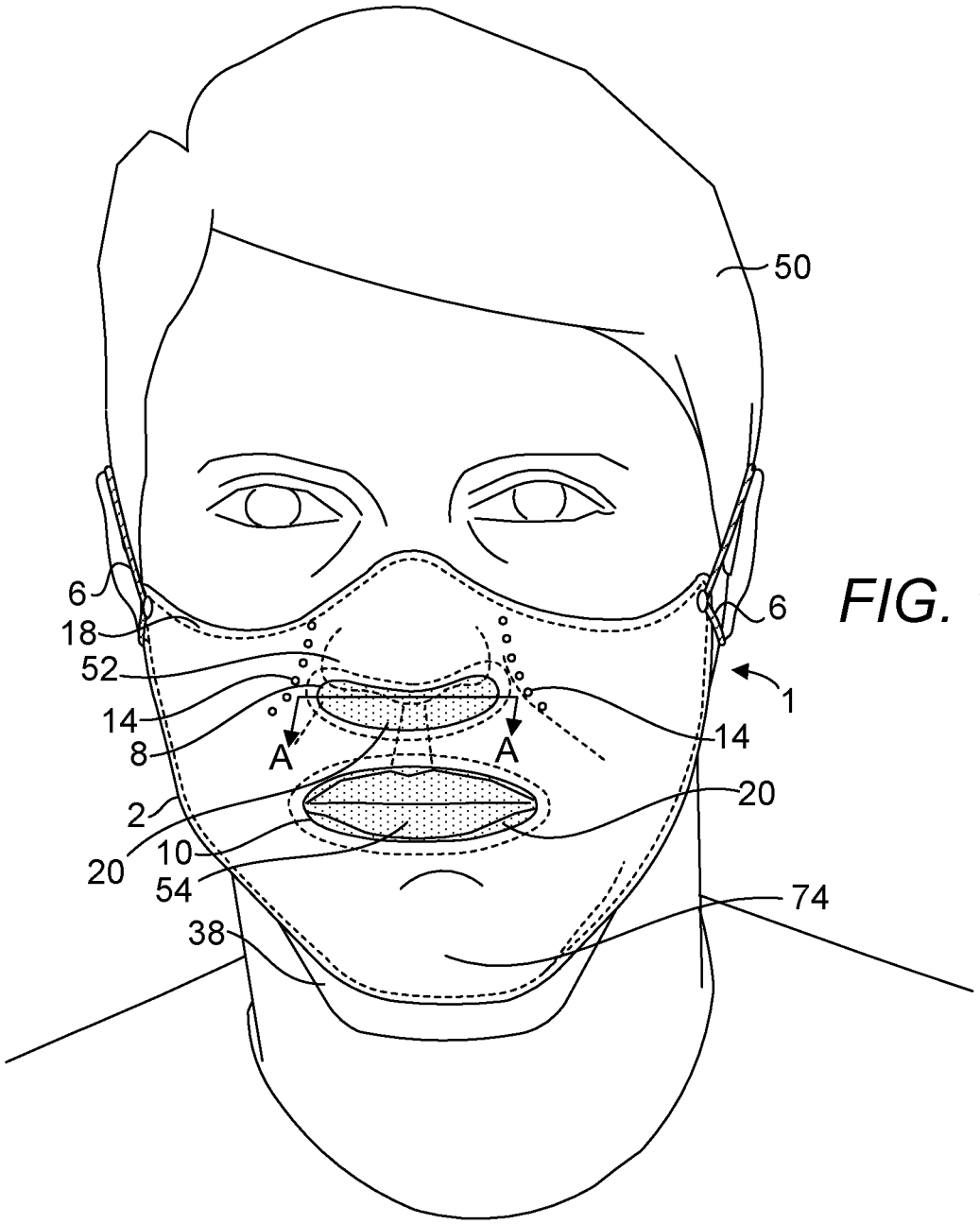
FIG. 1 depicts a front view of one embodiment of a present face mask disposed on the face of a user.

1—face mask
2—covering
4—temple
6—ear loop, e.g., elastic cord
8—nose opening
10—mouth opening
12—chin cup
14—vent hole
16—channel
18—seal
20—filter
22—pre-cut array of filters
24—two-sided tape
26—periphery
28—clip
30—protruding periphery
32—cap
34—vent hole
36—extended area under chin
38—tab
40—nose cup
42—nose curve hold vector
44—elastic cords ear attach hold vector
46—eye well
48—eye piece
50—user
52—nose of user
54—mouth of user
56—eye of user
58—protective layer
60—eye opening
62—slot
64—ear
66—angle made between an axis representing air flow through the nose and an axis representing air flow through the mouth
68—displacement of a point at the chin of a user
70—displacement of a point between the chin and the throat of a user
72—throat
74—chin
76—eye glasses
78—pin
80—inner surface of covering
82—outer surface of covering
84—space

PARTICULAR ADVANTAGES OF THE INVENTION

In one embodiment, the present face mask is a health mask which allows the user's face to be humanized and personalized. In one embodiment, as the face mask is clear, it allows most facial features of the user to show through the face mask even when the face mask is tinted. This allows facial features and thus identity to be recognized. As such, the use of the present face mask allows facial recognition algorithms to be applied more readily than opaque masks.

In one embodiment, the present face mask is produced by means of three dimensional (3D) printing using data from a custom facial scan of the user, removing the need for any physical tooling that needs to come in contact with the user.

The present face mask supports multiple applications via a simple filter type change. For instance, for COVID-19, a filter suitable for capturing a material of size of about 1 nm is used. For bacteria, second-hand smoke, allergen, pesticides, etc., a filter suitable for capturing a material of size of about 1 micrometer is used.

Excessive flexing and vibration inflicted upon prior art face masks can be avoided with the present face mask as the paths for inhalations and exhalations are targeted, thereby eliminating any potential for blowouts and virus breach and improving breathability.

In one embodiment, a protrusion or tab extending from a bottom edge of the covering enables hygienic attachment and/or removal of face mask as it serves as hand grasping point, minimizing cross contamination as the user does not need to touch other parts of the face mask to seat or remove the mask on the user's face.

The present face mask allows its user two distinct paths to take in oxygen and expel exhalations where both paths are filtered, i.e., an intake air path is filtered to eliminate or reduce pathogens while expelled air is filtered to eliminate or reduce the transmission of pathogens should the user be contagious. As these air paths are distinct, the carbon dioxide-rich exhaled air is not comingled with fresh air just drawn within the space encompassed by a present face mask, making it possible for inhalation of fresh air instead of oxygen-deprived air.

As blowout events of the face mask are eliminated with the present face mask, virus breach and chaffing of skin through such events is eliminated or at minimum, significantly reduced.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 2:
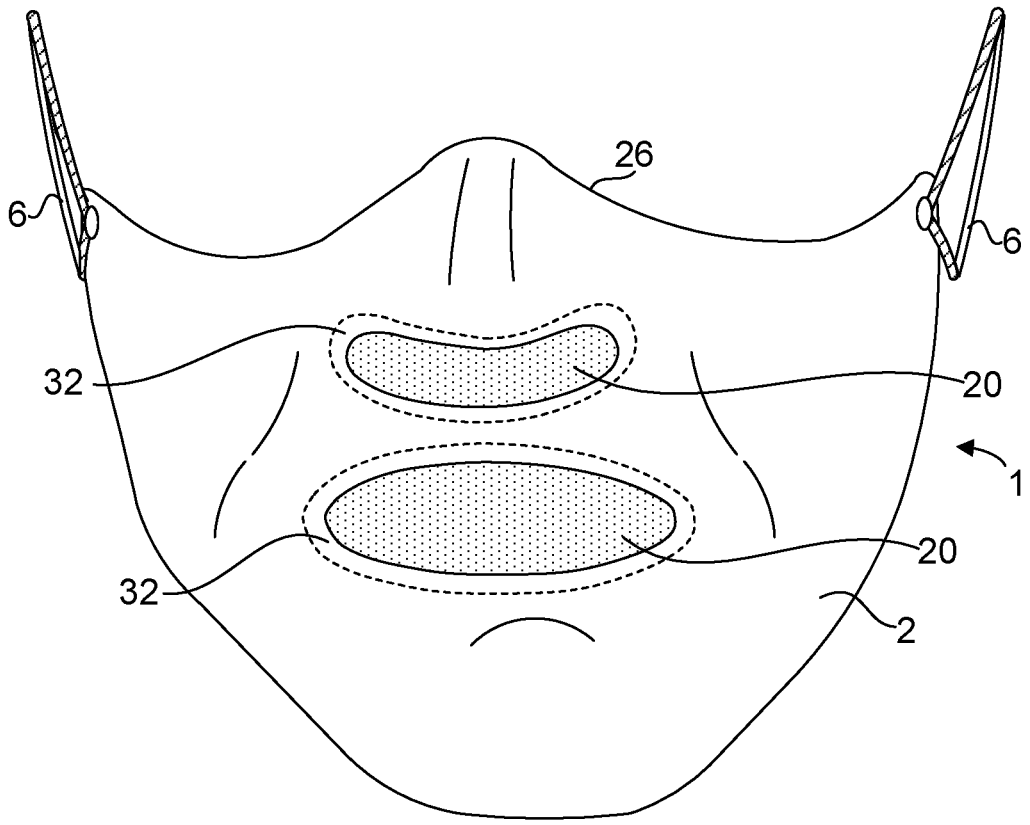
FIG. 2 depicts a front view of one embodiment of a present face mask.
Figure 3:
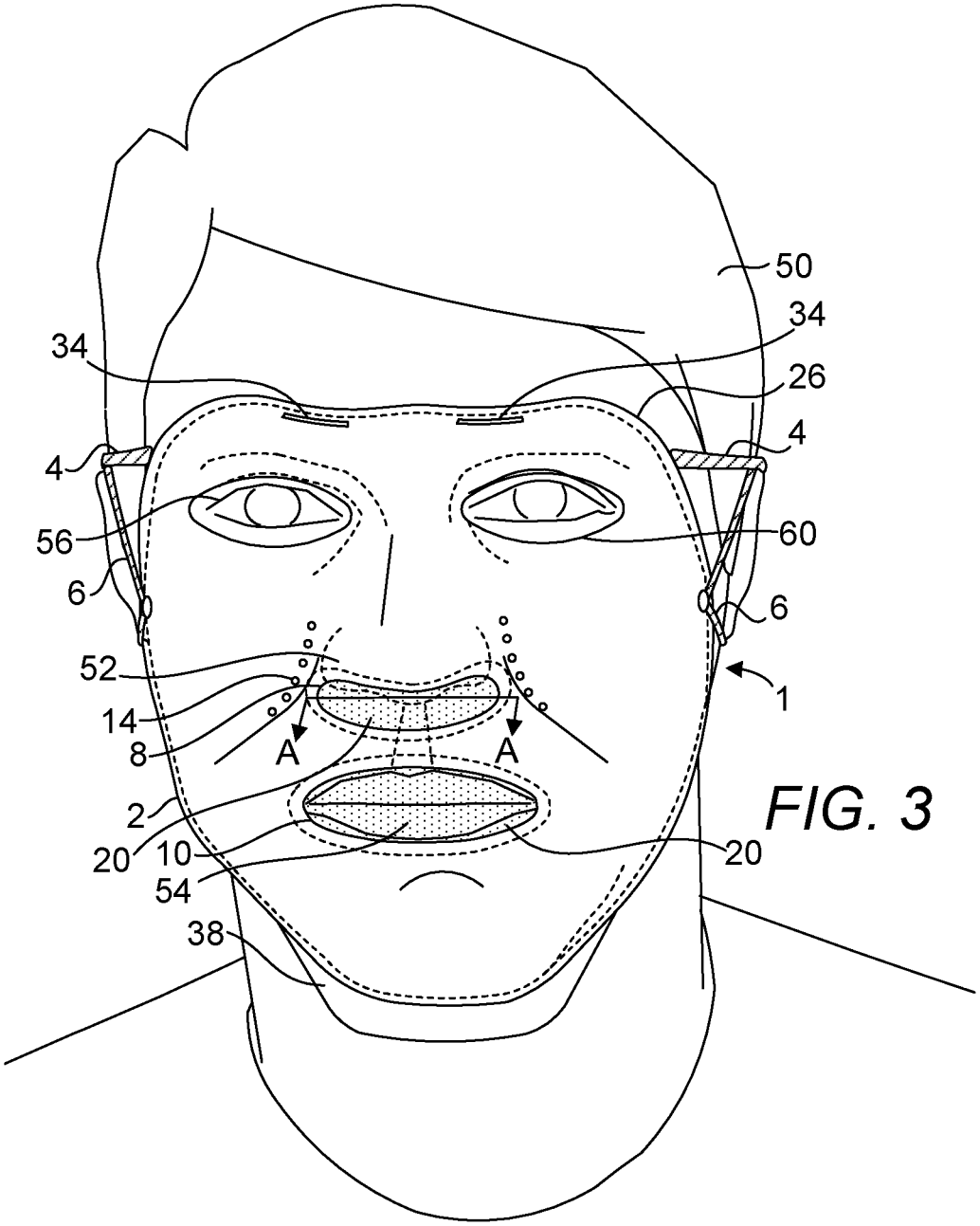
FIG. 3 depicts a front view of one embodiment of a present face mask disposed on the face of a user.
Figure 4:
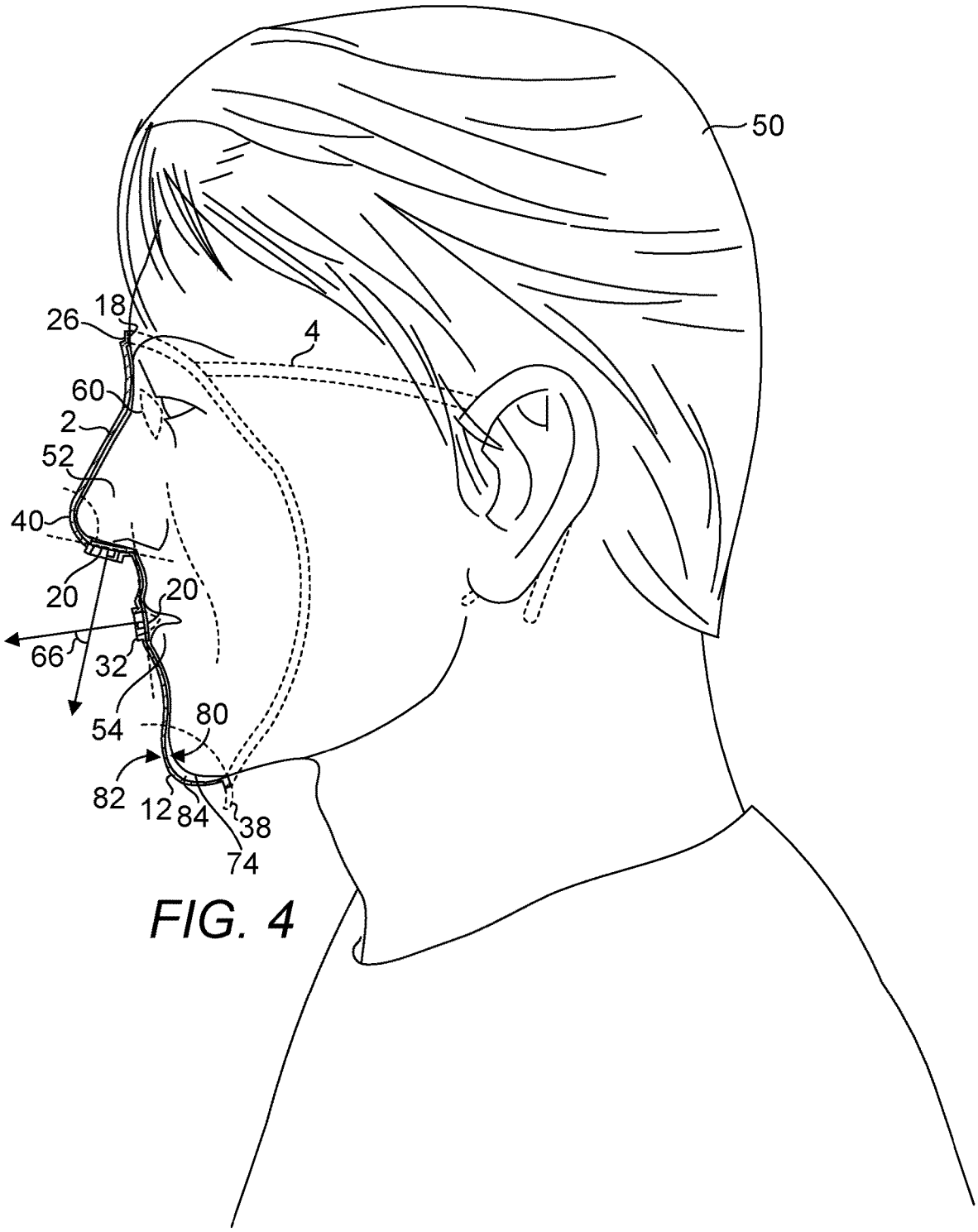
FIG. 4 depicts a side cross-sectional view of one embodiment of a present face mask disposed on the face of a user.

FIG. 1 depicts a front view of one embodiment of a present face mask disposed on the face of a user 50. FIG. 2 depicts a front view of one embodiment of a present face mask. FIG. 3 depicts a front view of one embodiment of a present face mask disposed on the face of a user 50. FIG. 4 depicts a side cross-sectional view of one embodiment of a present face mask disposed on the face of a user. In one embodiment, the face mask 1 is constructed from a rigid plastic, polymer resin, such as but not limited to, Polyethylene terephthalate (PET) that is adapted to cover one's nose, mouth and chin as shown in FIGS. 1 and 2. In another embodiment, the face mask 1 is also useful for covering additionally the eyes 56 of the user 50 as shown in FIGS. 3 and 4. In one aspect, a limited number of face mask sizes are provided, e.g., small, medium and large for children, teens and adults, respectively. However, in another aspect, the face mask can be made as a full custom fit mask constructed based on a three dimensional (3D) facial scan of a user via the three dimensional (3D) printing techniques. The face mask 1 includes a covering 2 including a periphery 26, a top end, a bottom end, the covering 2 configured to cover at least a portion of the nose 52 of the user 50 and at least a portion of the mouth 54 of the user 50, wherein the covering 2 is configured substantially according to the shape and size of the nose 52 of the user 50 and the mouth 54 of the user 50. A first opening 8 is disposed at a first location of the covering 2. The first location is a location of the covering 2 that coincides with the nose area of the user 50 when the face mask 1 is disposed on the user's face. While disposed on the user's face, the first opening 8 is just under the user's nostrils, allowing a direct path for any exhalations to exit the space between the mask 1 and the user 50 to avoid fogging to the user's glasses. A second opening 10 is disposed at a second location of the covering 2. The second location is a location of the covering 2 that coincides with the mouth area of the user 50 when the face mask 1 is disposed on the user's face. A first filter 20 is configured for covering the first opening 8. Therefore, an air flow is forced through this filter 20 from the outer surface of the filter to the inner surface of this filter 20 if the air flow is induced by the user's nose 52, e.g., in an inhalation, especially as the filter 20 is disposed significantly normal to the inhalation. A second filter 20 is configured for covering the second opening 10. Again, an air flow is forced through this filter 20 from the inner surface of the filter to the outer surface of this filter 20 if the air flow is induced by the user's mouth 54, e.g., in an exhalation, especially as the filter 20 is disposed significantly normal to the inhalation. A seal 18 disposed on an inner surface of the periphery 26 of the face mask 1. When the covering 2 is disposed over the nose 52 and the mouth 54 of the user, the seal 18 is seated on the face of the user 50, forming an inner space and an outer space, the inner space is defined by a space between the covering 2 and the user, limiting communication of a medium between the inner space and the outer space through the seal 18, forcing communication between the inner space and the outer space through the first filter 20 and the second filter 20. In one embodiment, at least one of the first filter 20 and the second filter 20 includes a nonwoven filter. In one embodiment, the covering 2 can be constructed from Polyethylene terephthalate (PET), Lexan® and other semi-rigid thin plastic as they are all non-porous. In one embodiment, the covering is clear. The face mask is washable and easily disinfected as it is non-porous. Contrast this to the porous silicone which does not lend itself to being washable. The material used for constructing the present face mask 1 allows most facial features of its user 50 to show through the face mask 1 even when the face mask 1 is tinted. This allows facial features and thus identity to be recognized. As such, the use of the present face mask 1 allows facial recognition algorithms to be applied more readily than opaque masks. In one embodiment, the covering is tinted. In one embodiment, the covering is constructed from a material capable of filtering out damaging UV rays. In one embodiment, the face mask 1 further includes an extension tab 38 extending from the bottom end of the covering 2, wherein the extension tab 38 is configured to provide a grasping point for removing or reseating the face mask 1. Opening 10 comes in multiple shapes, e.g., an oval, a shape conveying a smile and a shape conveying a no smile. Therefore, a user 50 of the present face mask 1 can convey a facial expression simply by wearing the mask 1. In one embodiment, two elastic ear loops or cords 6 each configured to be looped around an ear of a user to secure the face mask 1 that covers the nose, mouth and in one embodiment, also eyes of the user. For a more secure fit, a pair of temples 4 is provided to secure the top side edges of the covering 2 to the user if the face mask also covers the eyes 56. Alternatively, a face mask 1 may be secured using only the temples 4 and without the elastic loops 6. In one embodiment, there are further provided a plurality of vent holes 14 preferably disposed at a portion of the face mask 1 where moisture is known to collect, e.g., a portion of the face mask 1 that is higher than the mouth opening 10. Additional filters may be used in conjunction with these vent holes 14.

Referring to FIG. 3, the covering 2 is configured to cover at least a portion of the eyes 56 of the user with an extended portion extending from the top end of the covering 2 of FIG. 1, wherein the extended portion is configured substantially according to the shape and size of the eyes of the user 50. In the embodiment shown in FIG. 3, an eye opening 60 is disposed in each eye area.

Referring to FIGS. 3 and 4, the extended portion further includes a plurality of vent holes 34 disposed at a top edge of the extended portion. Vent holes 34 in the face mask 1 minimizes fogging of the face mask 1 and sweating of the user 50. Further, a plurality of channels 16 (see also FIG. 9) are disposed on a surface of seal 18 that comes in contact with the user's skin. Such channels 16 are useful for allowing limited ventilations to occur, making the use of the present face mask more comfortable. The seal 18 is provided with a rounded edge that comes in contact with a user's skin and without a sharp edge that can potentially cut into the user's skin due to rubbing on sensitive skin of the user's face, especially due to extended use, causing bleeding and scarring. The nose opening 8 is disposed in a first plane and the mouth opening 10 is disposed in a second plane, the first plane is disposed at an angle 66 of from at least about 45 degrees to the second plane. As this angle represents the degree of departure between the directions of the air paths of the nose and the mouth, by disposing this angle sufficiently large, this reduces the comingling of exhalations and inhalations either in the space between the face mask and the user or the environment outside of the face mask to result in a higher percentage of fresh air inhaled by the user. This space therefore does not contain air disposed at a pressure that is significantly different from the air outside of face mask 1, causing no significant air flow between the space and environment outside of the face mask 1 through the periphery 26 of the face mask while it is seated on a user's face. There is further provided a nose cup 40 which wraps around a user's nose to provide a secure hold to the user's nose to eliminate mask slippages relative to the user's nose, especially when the face mask 1 is properly urged against the user's face with the elastic ear loops 6 seated around the ears 64.

In one embodiment, the covering 2 further includes an inner surface 80, wherein at least one of the first filter 20 and the second filter 20 is disposed on the inner surface 80. In one embodiment, the covering 2 further includes an outer surface 82, wherein at least one of the first filter 20 and the second filter 20 is disposed on the outer surface 82. If disposed on the inner surface of a covering, accidental detachment of the filter 20 can be reduced as the filter is better protected as it is shielded by the covering 2. However, if convenience in replacing the filter/s 20 is desired, the filter/s 20 may be installed on the outer surface as the user can replace the filter/s 20 while the face mask 1 is seated on the user's face.

Figure 5:
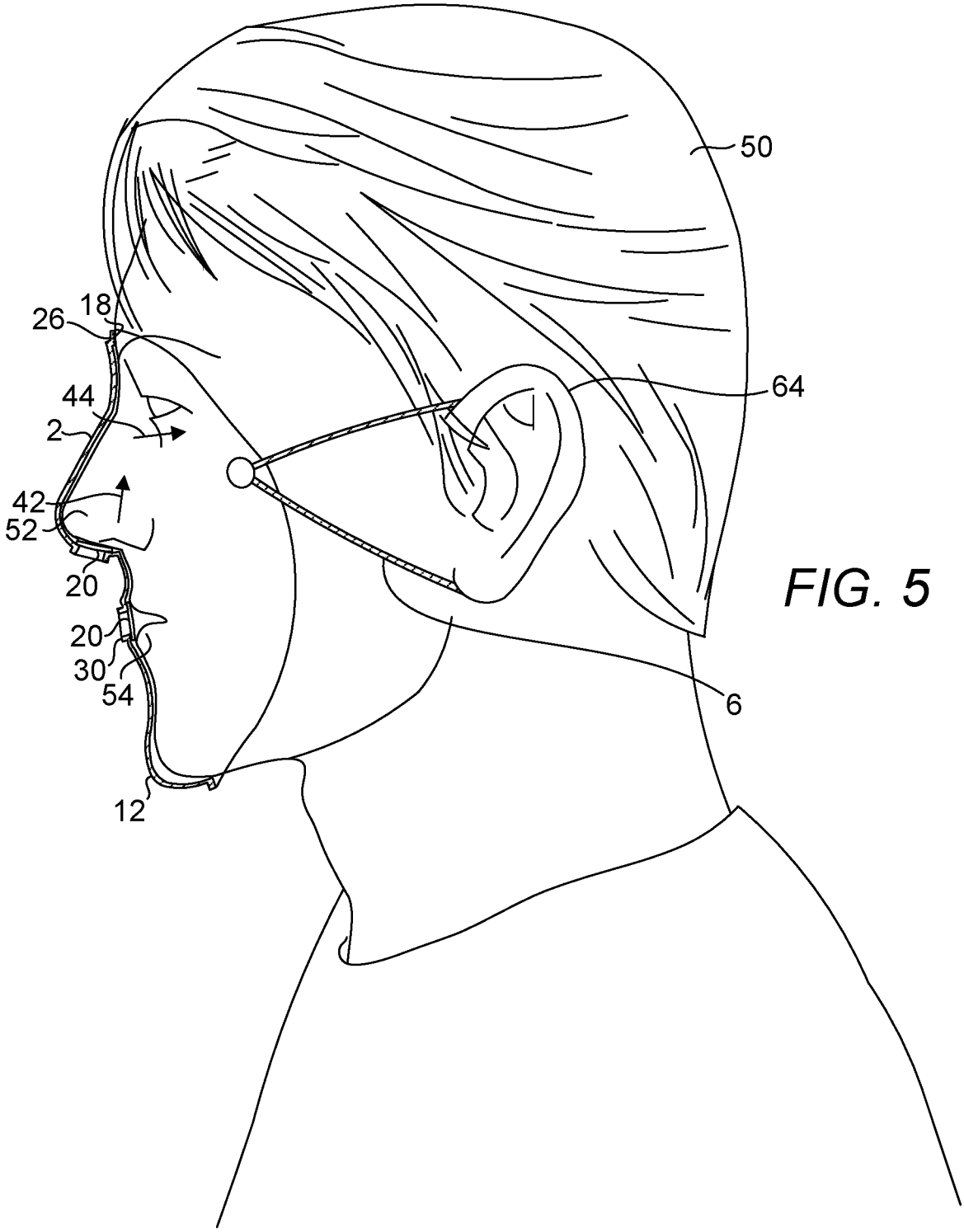
FIG. 5 depicts force vectors that hold a face mask from sliding off the nose due to a nose contour force vector and elastic cords.

FIG. 5 depicts force vectors 42, 44 that hold a face mask from sliding off the nose 52 due to a nose contour force vector 42 that acts upwardly and another force vector 44 that act rearwardly towards the user's ear, both due to the tension of cord 6. There is further provided a chin cup 12 which wraps around a user's chin to provide a secure hold under chin to minimize mask pulling, flexure and vertical movement in the face mask when the user talks. The chin cup 12 is preferably shaped and sized according the user's chin 74 contours but otherwise leaving space 84 between the chin cup 12 and user's chin 74 to avoid movements caused in the face mask 1 with every slightest movement in the chin. In one embodiment, the shape approximates a truncated cone with the base of the cone configured for receiving the user's chin 74.

Figure 6:
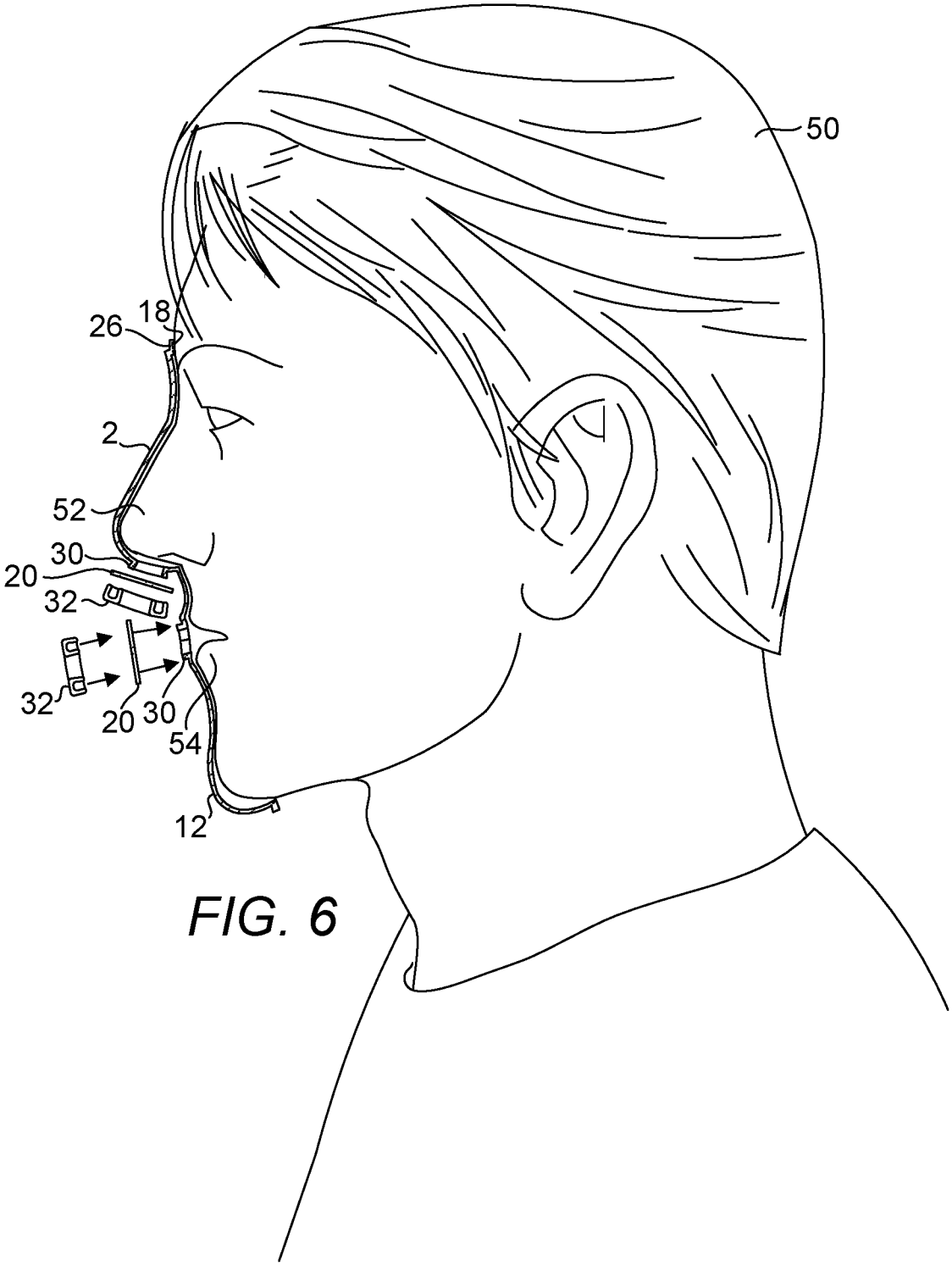
FIG. 6 depicts caps useful for securing filters to protrusions around the mouth and nose openings of the face mask to secure filters in a snap and hold fashion to the face mask.

In one embodiment, at least one of the first filter 20 and the second filter 20 is configured to be replaceable. FIG. 6 depicts caps 32 useful for securing filters to protrusions 30 around the mouth and nose openings 8, 10 of the face mask 1 to secure filters 20 in a snap and hold fashion to the covering 2.

Figure 7:
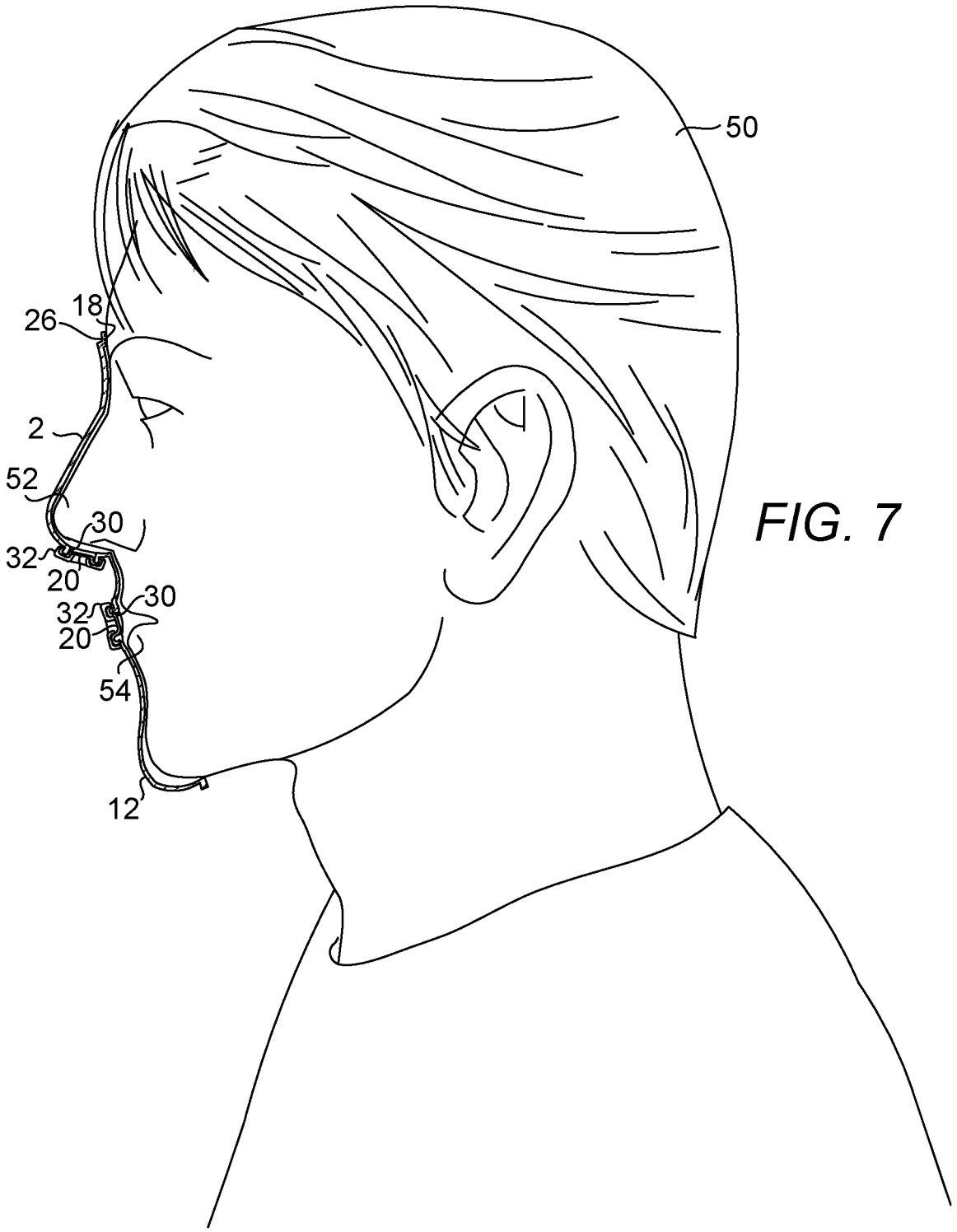
FIG. 7 depicts caps shown in FIG. 6 which have been used to secured filters to the face mask.

FIG. 7 depicts caps 32 shown in FIG. 6 which have been used to secure filters 20 to the face mask 1. In this embodiment, an opening 8, 10 further includes a protrusion 30 disposed on its periphery. It shall be noted that the protrusion 30 extends in a direction normal to the opening 8, 10. The protrusion 30 is configured to receive a filter before receiving a cap pressed against the protrusion to secure the filter 20 to the opening 8, 10. The cap 32 is preferably constructed as a continuous piece and therefore termed a "ringed" cap that leaves no breaks along the periphery of the nose opening 8 or the mouth opening 10 upon its coupling with a filter 20 and a protrusion 30.

Figure 8:
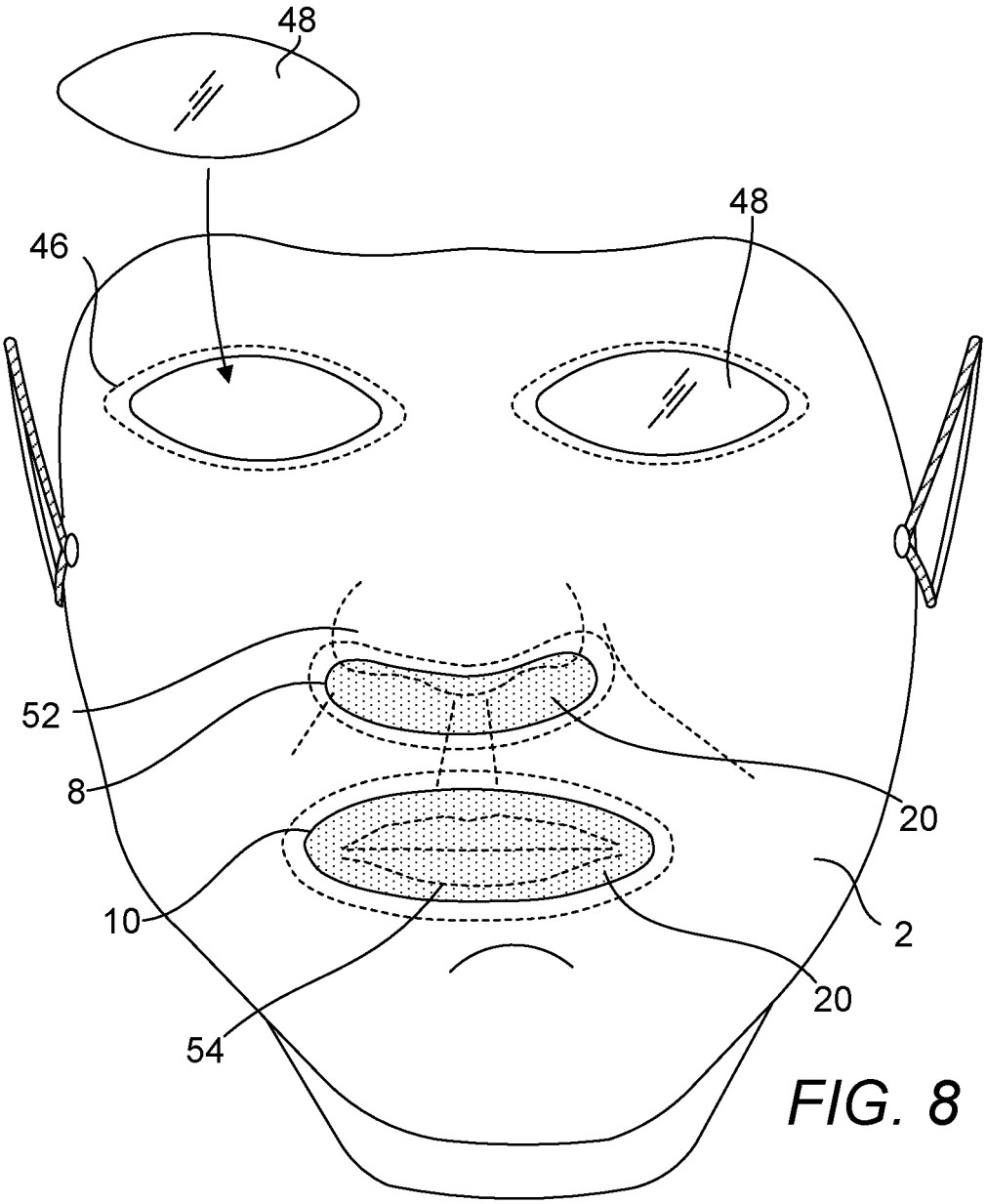
FIG. 8 depicts custom eye pieces suitable for use with custom eye wells of a face mask.

FIG. 8 depicts custom eye pieces 48 suitable for use with custom eye wells 46 of a face mask. In one embodiment, the face mask further includes a vision-altering layer disposed on the extended portion. In one embodiment, the vision-altering layer can be a vision corrective lens, a light-sensitive darkening device, an anti-reflective coating, a polarized lens, a night vision device and any combinations of these layers. Eye wells 46 are configured for receiving the custom eye piece 48, e.g., in a snap-fit, removeable fashion. The eye pieces can be constructed from a material, e.g., but not limited to, glass or polycarbonate.

Figure 9:
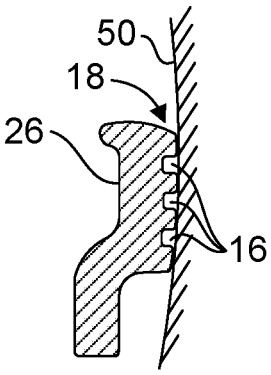
FIG. 9 depicts a cross-sectional view of a seal.

FIG. 9 depicts a cross-sectional view of a seal 18. It shall be noted that a plurality of channels 16 are disposed on a surface of the seal 18 which comes in contact with a user's face allowing air to come between the seal 18 and the user's face for comfort. In one embodiment, none of the channels 16 are exposed to the ambient environment of the seal 18 while the face mask seated on a user's face. In another embodiment, at least one of the channels 16 is exposed to the ambient environment of the seal 18 for the purpose of pressure and humidity normalization between the space between the covering 2 and the ambient environment of the seal 18. However, the channels 16 preferably do not bridge the environment between the space encompassed by the face mask 1 and the environment surrounding it.

Figure 10:
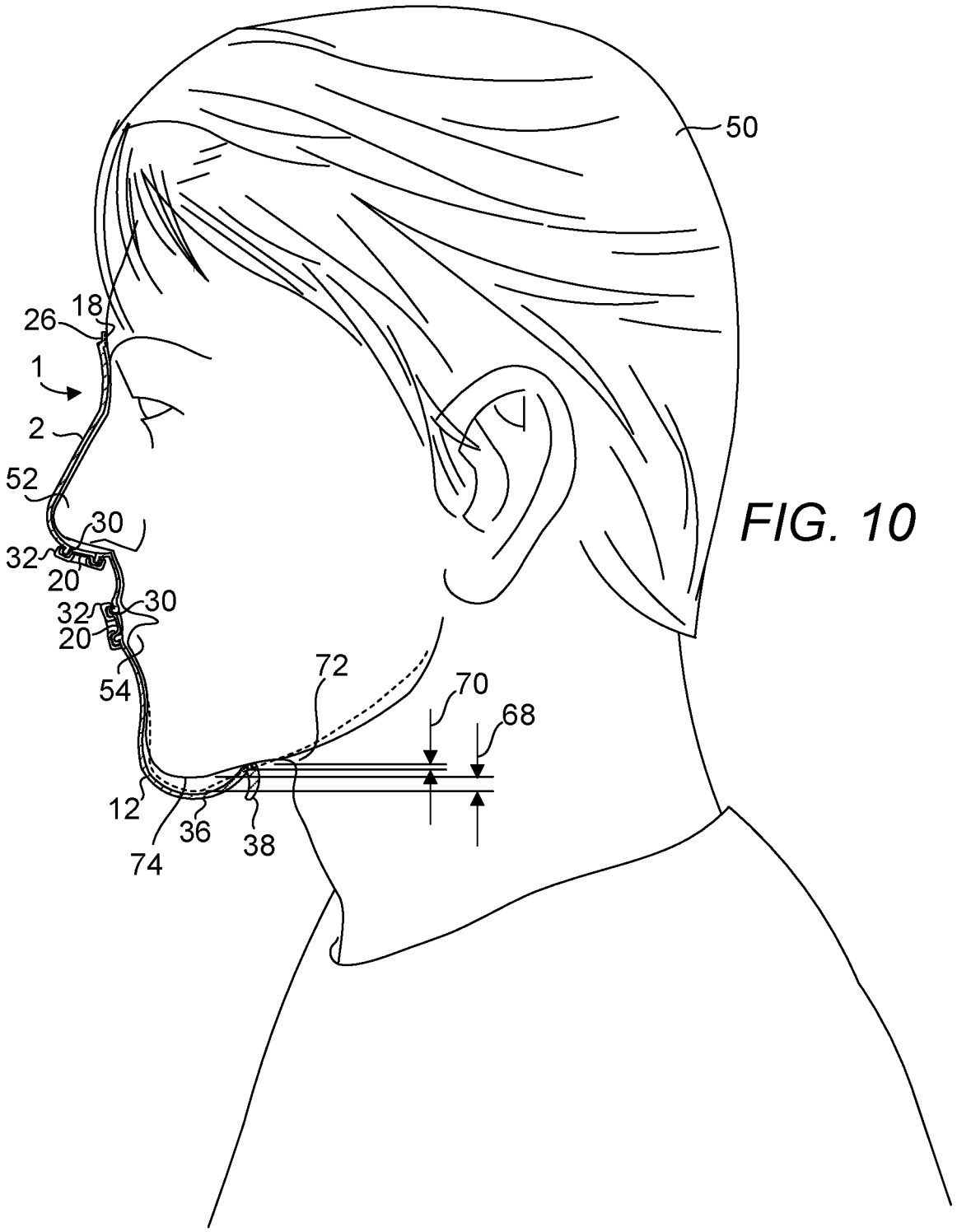
FIG. 10 is a side cross-sectional view of a present face mask, depicting an extended under-chin area that extends the sealed periphery under chin closer to the throat of the user.

FIG. 10 is a side cross-sectional view of a present face mask 1, depicting an extended under-chin area 36 that extends the seal 18 under chin closer to the throat of the user 50. In this embodiment, as the contact point between the bottom periphery of the face mask 1 and the user 50 is moved closer to the throat, any movements of the jaw of the user, e.g., due to talking, etc., will cause a smaller displacement of the face mask 1. Note that the dash line represents the position of the jaw of the user when the user talks. Displacement 68 represents the amount of drop in the jaw at the chin of the user while displacement 70 represents the amount of drop in the jaw at the point of the user where the periphery 26 of the face mask 1 comes in contact with the user 50. Note that displacement 70 is significantly less than displacement 68. As the periphery is disposed at a location with less jaw displacement, i.e., between the chin 74 and the throat 72, a user of this embodiment of the present face mask 1 can better tolerate movements in the jaw as the face mask 1 has less relative movement under the chin 74 and therefore less abrasion of the mask 1 with respect to the user's facial skin and minimizes the inadvertent falling of the mask 1, exposing the nose 52 as in prior art cloth masks.

Figure 11:
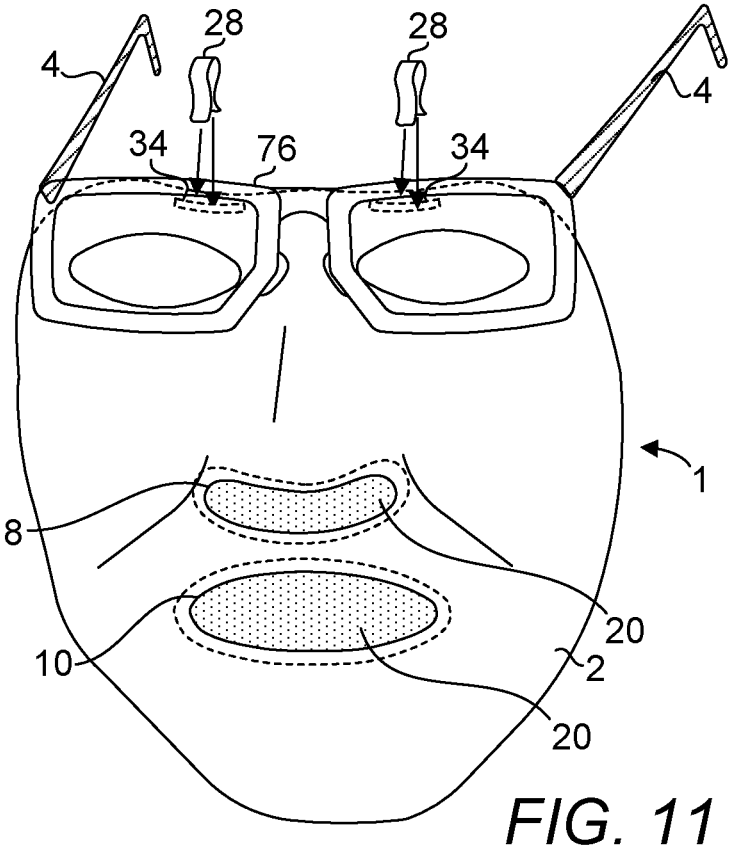
FIG. 11 is a diagram of one embodiment of a present face mask where the face mask is secured by being coupled to a pair of eye glasses.

FIG. 11 is a diagram of one embodiment of a present face mask 1 where the covering 2 is secured by being coupled to a pair of eye glasses 76. For prescription eye glass users who desire additional protection to the eyes, the embodiment shown herein allows a user to cover the eyes of the user with the face mask 1 before disposing the eye glasses over the seated face mask 1. It shall be noted that the ear loops 6 as disclosed elsewhere herein, are no longer necessary. Here, two clips 28 are provided where one leg of each clip 28 is disposed through a vent hole 34 on a rear surface of the face mask 1 and the other leg of the clip 28 disposed over a front surface of an eye piece of the eye glasses 76 to secure the face mask 1 to the eye glasses 76.

Figure 12:
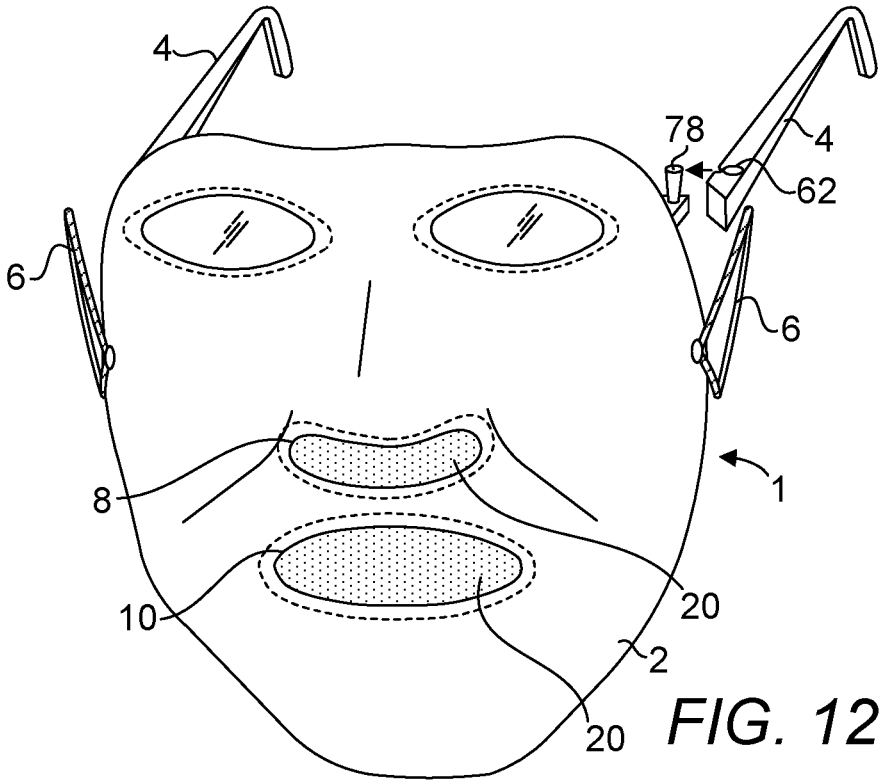
FIG. 12 is a diagram of one embodiment of a present face mask where the temples are configured to be replaceable.

FIG. 12 is a diagram of one embodiment of a present face mask 1 where the temples 4 are configured to be replaceable. Here, the temples 4 are configured to be replaceable, i.e., the temples can be removed when they are not needed and reinstalled before use. In installing a temple 4, the temple 4 is first disposed such that the slot 62 on the temple 4 is aligned with a pin 78 secured to the face mask 1 at or near the periphery 26 of face mask 1.

Figure 13:
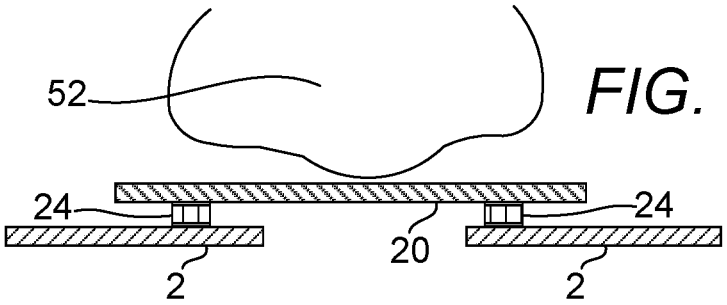
FIG. 13 depicts a cross-sectional view of a filter shown attached to a nose opening.

FIG. 13 depicts a cross-sectional view of a filter 20 shown attached to a nose opening 8 as a result of taking a cross-sectional view along line A-A of FIG. 1. It shall be noted that, in this instance, the filter is disposed on an inner surface of the covering 2. However, as disclosed elsewhere herein, the filter can be disposed on an outer surface of the covering 2.

Figure 14:
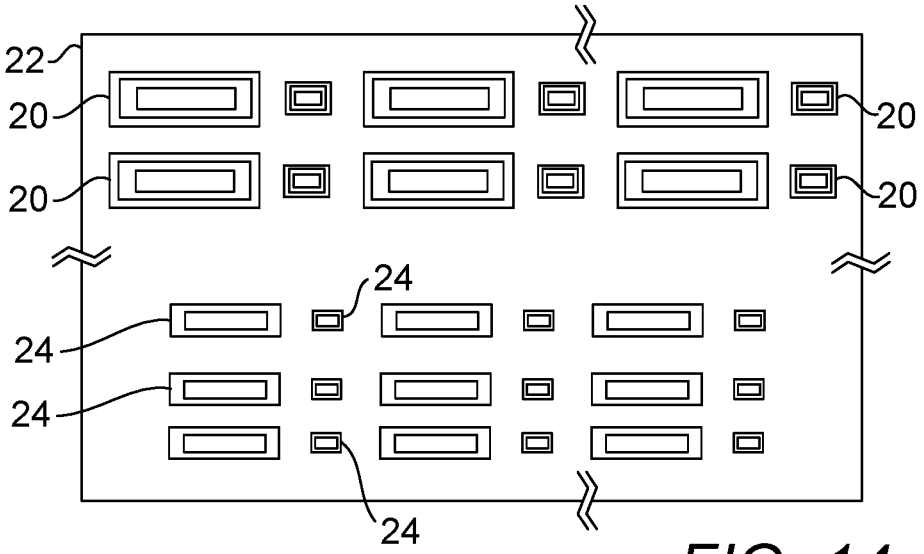
FIG. 14 depicts a pre-formed filter sheet ready for use by an end user.
Figure 15:
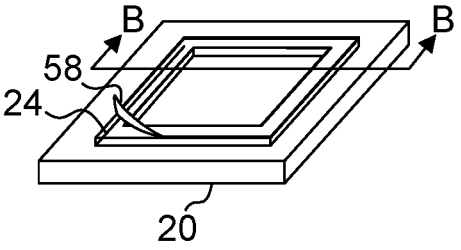
FIG. 15 depicts a filter of FIG. 14 with a factory-applied two-sided tape including a removable protective layer.
Figure 16:
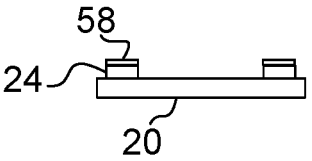
FIG. 16 is a diagram depicting a cross-sectional view of a filter of FIG. 15 as taken along line B-B of FIG. 16.

FIG. 14 depicts a pre-formed filter sheet ready for use by an end user. FIG. 15 depicts a filter 20 of FIG. 14 with a factory-applied two-sided tape 24 including a removable protective layer 58. FIG. 16 is a diagram depicting a cross-sectional view of a filter of FIG. 15 as taken along line B-B of FIG. 15. Both types of filters 20, one type for the nose opening 8 and the other for the mouth opening 10 are disposed in a multi-up array sheet 22 with a pre-cut size and shape. To use a filter, one simply pulls a pre-cut filter 20 from the sheet, peels of the paper covering 58 from double-sided tape 24 before placing and pressing the filter 20 to an appropriate location on an inner surface of the covering 2. Alternatively, instead of installing the filter 20 on an inner surface of the covering 2, the filter 20 may be installed on the outer surface of the covering 2.

Alternately the two-sided tape 24 may be disposed in a separate pre-formed, pre-cut array where the user can apply the two-sided tape to the covering 2 directly first and followed by a filter 20.

Figure 17:
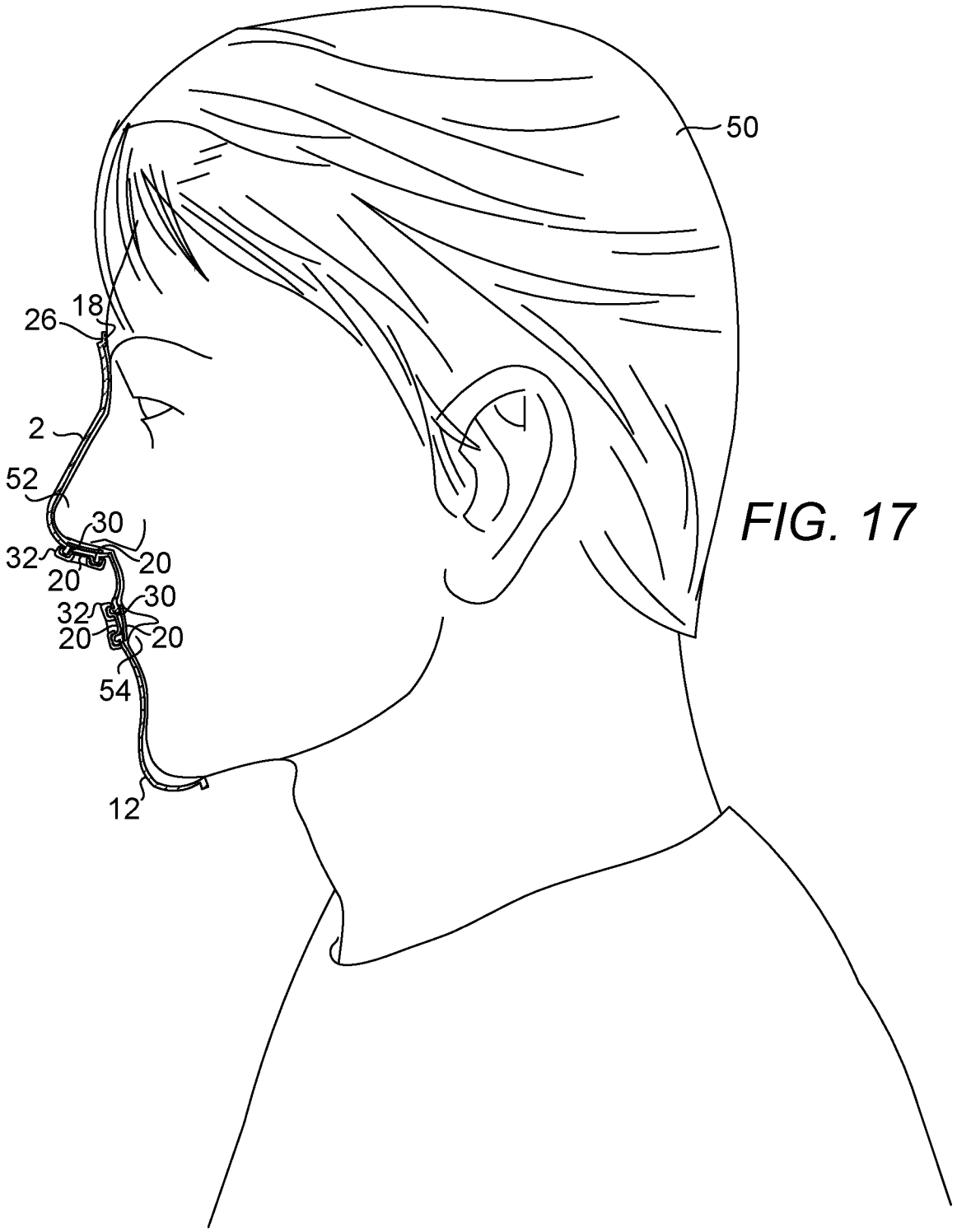
FIG. 17 is a diagram depicting the use of two filters for each opening.

FIG. 17 is a diagram depicting the use of two filters for each opening. It shall be noted that each opening 8, 10 is sealed with two filters 20, one on an inner surface of the covering 2 and the other on an outer surface of the covering 2. Although the face mask 1 is shown to include a ringed cap 32-secured filter 20 on the outer surface of the covering 2, the filter may alternatively be secured using two-sided tape instead as disclosed elsewhere herein. In one embodiment not shown, there is further provided a face mask 1 with no protrusions 32 around an opening 8, 10 to provide larger flat surfaces for filters 20 to be attached. By using two filters for each opening, the type of filtration through each opening can be modified. For instance, a filter capable of capturing a particular particle filtering size can be used. A first filter can be used for capturing larger particles while the other for capturing smallest particles. Further, by using two filters for each opening, the filter useful for capturing smaller particles will last longer as they are not plugged up by larger particles rapidly which can reduce the efficiency rating and life of both filters and make inhalations and exhalations harder. No one filter is optimized to optimize all aspects of filtering to the highest level (efficiency, life, ease of communication, etc.) By putting two filters in the series in an air flow path, one can select a combination that maximizes the aforementioned parameters for each specific application the face mask is used for. With "N" filter types, there are 2 to the "N"th power of combinations that can be used. By having two filters, one is able to change the outside filter in-situ of the use without breaching the path between the space between the user and the face mask 1 and the environment outside of the face mask 1. A user, with no added assistance, can remove the ringed cap 32, remove the filter 20, add a new filter 20 and re-apply the ringed cap 32. For a health care worker, there is no need for the worker to leave the area, de-gown, change a mask, clean the hands from cross contamination and return to the on-going work area. The two-filter configuration is especially useful for health care and first responders as time saving and cross contaminations are important issues faced by these personnel especially when these personnel may not have opportunities to replace their protective equipment including face masks when working a demanding shift over an extended duration.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A face mask for a user having a face, a nose and a mouth, said face mask comprising:

(a) a covering comprising a periphery, a top end, a bottom end, said covering configured to cover at least a portion of the nose of the user and at least a portion of the mouth of the user;

(b) a first opening disposed at a first location of said covering in a first plane, wherein said first location configured to be disposed over the nose of the user and said first plane configured to be disposed normal to an air flow through the nose of the user, when in use;

(c) a second opening disposed at a second location of said covering in a second plane, wherein said second location configured to be disposed over the mouth of the user and said second plane configured to be disposed normal to an air flow through the mouth of the user, when in use;

(d) a first filter configured for covering said first opening;

(e) a second filter configured for covering said second opening; and (f) a seal disposed on said periphery, wherein when said covering is disposed over the nose and the mouth of the user, said seal is seated on the face of the user, forming an inner space and an outer space, said inner space is defined by a space between said covering and the user, limiting communication of a medium between said inner space and said outer space through said seal, forcing communication between said inner space and said outer space through said first filter and said second filter.

2. The face mask of claim 1, the user further having eyes, said covering configured to cover at least a portion of the eyes of the user with an extended portion extending from said top end of said covering, wherein said seal is configured to extend to a periphery of said extended portion.

3. The face mask of claim 2, further comprising a vision-altering layer disposed on said extended portion.

4. The face mask of claim 3, wherein said vision-altering layer comprises a vision-altering layer selected from the group consisting of a vision corrective lens, a light-sensitive darkening device, an anti-reflective coating, a polarized lens and a night vision device and any combinations thereof.

5. The face mask of claim 2, wherein said extended portion further comprises at least one vent hole.

6. The face mask of claim 2, further comprising a fastener disposed on said extended portion, wherein said fastener configured for fastening said face mask to a pair of eye glasses.

7. The face mask of claim 2, further comprising a fastener disposed on said extended portion, wherein said fastener configured for fastening said face mask to at least one temple of a pair of eye glasses.

8. The face mask of claim 2, further comprising a pair of temples configured to be attachable to the extended portion.

9. The face mask of claim 8, wherein said pair of temples is configured to be replaceable.

10. The face mask of claim 1, wherein at least one of said first filter and said second filter is configured to be replaceable.

11. The face mask of claim 1, wherein at least one of said first filter and said second filter comprises a nonwoven filter.

12. The face mask of claim 1, wherein said covering is constructed from a material selected from the group consisting of Polyethylene terephthalate (PET) and semi-rigid thin plastic.

13. The face mask of claim 1, wherein said covering is constructed from a material selected from the group consisting of a clear material, a tinted material, a material capable of filtering out damaging UV rays, and any combinations thereof.

14. The face mask of claim 1, further comprising an extension tab extending from said bottom end of said covering, wherein said extension tab is configured to provide a grasping point for removing said face mask.

15. The face mask of claim 1, wherein said first plane is disposed at an angle of at least about 45 degrees with respect to said second plane.

16. The face mask of claim 1, wherein said covering further comprises an inner surface, wherein at least one of said first filter and said second filter is disposed on said inner surface.

17. The face mask of claim 1, wherein said covering further comprises an outer surface, wherein at least one of said first filter and said second filter is disposed on said outer surface.

18. The face mask of claim 1, further comprising a third filter configured for covering said first opening and a fourth filter configured for covering said second opening, wherein said covering further comprises an inner surface and an outer surface and one of said first filter and said third filter is configured to cover said first opening at one of said inner surface and said outer surface, the other one of said first filter and said third filter is configured to cover said first opening at the other one of said inner surface and said outer surface and one of said second filter and said fourth filter is configured to cover said second opening at one of said inner surface and said outer surface, the other one of said third filter and said fourth filter is configured to cover said second opening at the other one of said inner surface and said outer surface.

19. The face mask of claim 1, wherein at least one of said first opening and said second opening further comprises a protrusion disposed on its periphery, said protrusion extending in a direction normal to said at least one of said first opening and said second opening, said protrusion is configured to receive one of said first filter and said second filter disposed over said protrusion before receiving a cap pressed against said protrusion to secure a periphery of said one of said first filter and said second filter and to secure one of said first filter and said second filter to one of said first opening and said second opening.

20. The face mask of claim 1, wherein the user further having a chin and a throat and said periphery comprises a bottom periphery configured to be disposed in an area of the user that is between the chin and the throat of the user.

* * * * *